US009211581B2

(12) United States Patent
Lee et al.

(10) Patent No.: US 9,211,581 B2
(45) Date of Patent: Dec. 15, 2015

(54) STRIPPER ASSEMBLIES AND COMPONENTS THEREOF FOR MULTI-TOOL PUNCH ASSEMBLIES

(75) Inventors: Brian J. Lee, Elk River, MN (US); John H. Morehead, White Bear Lake, MN (US)

(73) Assignee: WILSON TOOL INTERNATIONAL INC., White Bear Lake, MN (US)

( * ) Notice: Subject to any disclaimer, the term of this patent is extended or adjusted under 35 U.S.C. 154(b) by 1810 days.

(21) Appl. No.: 11/859,220

(22) Filed: Sep. 21, 2007

(65) Prior Publication Data

US 2009/0078098 A1 Mar. 26, 2009

(51) Int. Cl.

| | |
|---|---|
| ***B26D 7/00*** | (2006.01) |
| ***B26D 7/18*** | (2006.01) |
| ***B21D 45/06*** | (2006.01) |
| ***B21D 28/12*** | (2006.01) |
| ***B21D 45/00*** | (2006.01) |

(52) U.S. Cl.

CPC ..... *B21D 28/12* (2013.01); *B21D 45/006* (2013.01); *Y10T 29/49947* (2015.01); *Y10T 83/2144* (2015.04); *Y10T 83/2159* (2015.04)

(58) Field of Classification Search

CPC ..... B21D 28/12; B21D 45/006; B21D 45/06; B21D 45/10; Y10T 83/2142; Y10T 83/2144; Y10T 83/2159; Y10T 83/2172; Y10T 83/8732

USPC ..... 83/132, 133, 146, 552, 690, 691, 140, 83/145; 215/317, 388

See application file for complete search history.

(56) References Cited

U.S. PATENT DOCUMENTS

| | | | | |
|---|---|---|---|---|
| 4,092,888 | A | | 6/1978 | Wilson |
| 4,248,111 | A | | 2/1981 | Wilson et al. |
| 4,446,767 | A | | 5/1984 | Wilson |
| 4,486,941 | A | | 12/1984 | Scott et al. |
| 4,779,329 | A | | 10/1988 | Nordquist et al. |
| RE32,837 | E | | 1/1989 | Corni |
| 4,929,276 | A | * | 5/1990 | Chun et al. ..... 83/552 |
| 4,976,180 | A | | 12/1990 | Otto |
| 4,989,484 | A | | 2/1991 | Johnson et al. |
| 4,993,294 | A | | 2/1991 | Chun et al. |
| 4,998,958 | A | | 3/1991 | Chun et al. |
| 5,048,385 | A | * | 9/1991 | Eckert et al. ..... 83/34 |
| 5,056,392 | A | | 10/1991 | Johnson et al. |
| 5,062,337 | A | | 11/1991 | Johnson et al. |
| 5,081,891 | A | | 1/1992 | Johnson et al. |
| 5,127,293 | A | | 7/1992 | Chatham |

(Continued)

FOREIGN PATENT DOCUMENTS

FR 2267170 A1 11/1975

OTHER PUBLICATIONS

PCT/US2008/075683, Partial International Search Report and Invitation to Pay Additional Fees, dated Dec. 17, 2008, 6 pages.

(Continued)

*Primary Examiner* — Clark F Dexter

(74) *Attorney, Agent, or Firm* — Fredrikson & Byron, P.A.

(57) ABSTRACT

A multi-tool punch assembly includes one or more types of quick-release-type engagement members for a stripper assembly thereof. Strippers of the stripper assembly may be formed by individual stripper members reversibly coupled to a plate of the stripper assembly; and the stripper assembly may further include an information storage device for storing punch tool information.

41 Claims, 7 Drawing Sheets

(56) References Cited

U.S. PATENT DOCUMENTS

| | | | | |
|---|---|---|---|---|
| 5,195,413 | A * | 3/1993 | Johnson | 83/132 |
| 5,271,303 | A | 12/1993 | Chatham | |
| 5,301,580 | A | 4/1994 | Rosene et al. | |
| 5,410,927 | A | 5/1995 | Omata et al. | |
| 5,667,085 | A * | 9/1997 | Ogden et al. | 215/220 |
| 5,848,563 | A | 12/1998 | Saito | |
| 6,047,579 | A | 4/2000 | Schmitz | |
| 6,082,516 | A | 7/2000 | Willer | |
| 6,163,734 | A | 12/2000 | Shigefuji et al. | |
| 6,196,103 | B1 | 3/2001 | Schneider et al. | |
| 6,279,445 | B1 * | 8/2001 | Rosene et al. | 83/698.91 |
| 6,311,594 | B1 | 11/2001 | Ootsuka | |
| 6,344,018 | B1 | 2/2002 | Aizawa | |
| 6,568,593 | B2 | 5/2003 | Hetzer | |
| 6,895,849 | B2 | 5/2005 | Rosene et al. | |
| 7,461,579 | B2 * | 12/2008 | Kobayashi | 83/552 |
| 7,726,554 | B2 * | 6/2010 | Thielges et al. | 234/43 |
| 2001/0039867 | A1 * | 11/2001 | Ostini | 83/552 |
| 2003/0173325 | A1 * | 9/2003 | Mavin | 215/270 |
| 2010/0212469 | A1 * | 8/2010 | Thielges et al. | 83/552 |
| 2010/0229701 | A1 * | 9/2010 | Thielges et al. | 83/13 |

OTHER PUBLICATIONS

PCT/US2008/075683, International Search Report and Written Opinion dated Feb. 9, 2009, 21 pages.

* cited by examiner

STRIPPER ASSEMBLIES AND COMPONENTS THEREOF FOR MULTI-TOOL PUNCH ASSEMBLIES

TECHNICAL FIELD

The present invention pertains to multi-tool punch tool assemblies and more particularly to stripper assemblies thereof.

BACKGROUND

Multi-tool punch assemblies are known in the art to provide a selection from a plurality of punch tools at a single station of a punch press. Multi-tool punch assemblies typically employ a punch guide that is adapted to move each punch tool, of the plurality of punch tools carried by the guide, into and out from a working position, for example, via rotation about its own axis within a turret press station in which the guide is mounted.

Those skilled in the art are familiar with the stripping function that is fundamental to the operation of punch assemblies in order to ensure that punched material is separated from the punch tip; several types of stripper assemblies for mounting onto multi-tool punch guides have been previously disclosed. However, there is still a need for new stripper assemblies, and components thereof, that can facilitate more efficient and simpler methods for assembling multi-tool punch assemblies.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention. Examples of constructions, materials and dimensions are provided for selected elements, and all other elements employ that which is known to those of skill in the field of the invention. Those skilled in the art will recognize that many of the examples provided have suitable alternatives that can be utilized.

Figure 1:
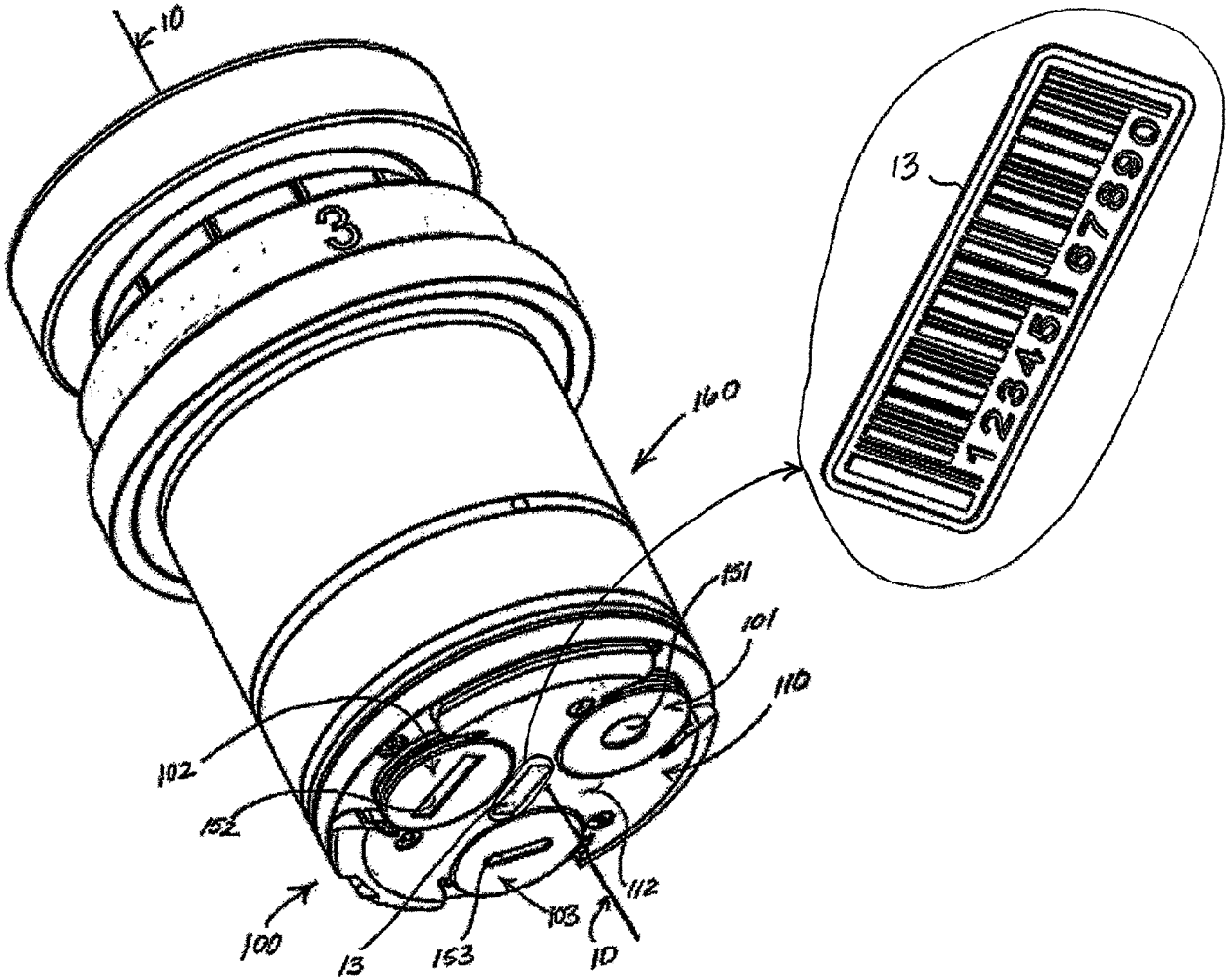
FIG. 1 is perspective view of a multi-tool punch assembly for use in a punch press, according to some embodiments of the present invention.
Figure 2:
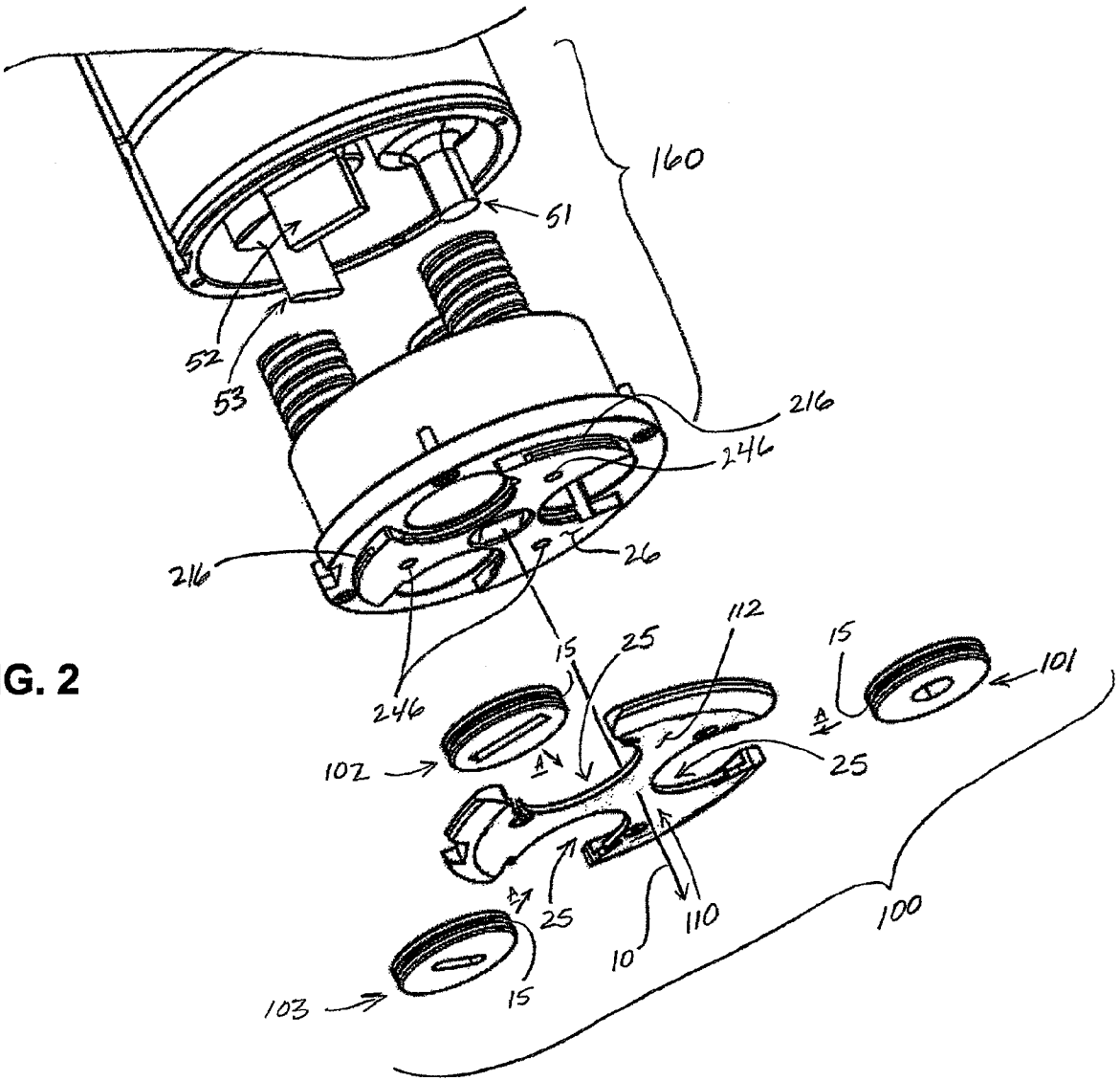
FIG. 2 is an exploded perspective view of a portion of the multi-tool punch assembly shown in FIG. 1, according to some embodiments.

FIG. 1 is perspective view of a multi-tool punch assembly for use in a punch press, according to some embodiments of the present invention; and FIG. 2 is an exploded perspective view of a portion of the multi-tool punch assembly shown in FIG. 1. The assembly of FIGS. 1 and 2 may be a rotary indexing type, which may be mounted, for example, in an upper turret of a rotary turret punch press in conjunction with a corresponding die set mounted in a lower turret of the press. It should be noted that embodiments of the present invention may be employed by other types of multi-tool punch assemblies, which are compatible for mounting in alternative types of ram-driven presses, for example, a Trumpf-style press, known to those skilled in the art, that brings tool assemblies, held in a cartridge, one at a time from a rail into a working position of the press. FIGS. 1 and 2 illustrate the assembly including a punch holder, or guide 160, which carries a plurality of punch tools 51, 52, 53, and a stripper assembly 100, which includes a plate 110 and a plurality of strippers or stripper members 101, 102, 103; each stripper 101, 102, 103 includes a punch port 151, 152, 153 through which a corresponding punch tool 51, 52, 53 extends when activated.

According to the illustrated embodiment, individual stripper members, which are approximately coplanar with plate 110, form each stripper 101, 102, 103, when reversibly coupled to plate 110. FIG. 2 further illustrates plate 110 including a plurality of grippers or gripper slots 25 for reversibly coupling members 101, 102, 103; and FIG. 1 shows each gripper 25 extending about a perimeter of a corresponding stripper member 101, 102, 103. Grippers 25 will be described in greater detail below, in conjunction with FIG. 3.

Figure 3:
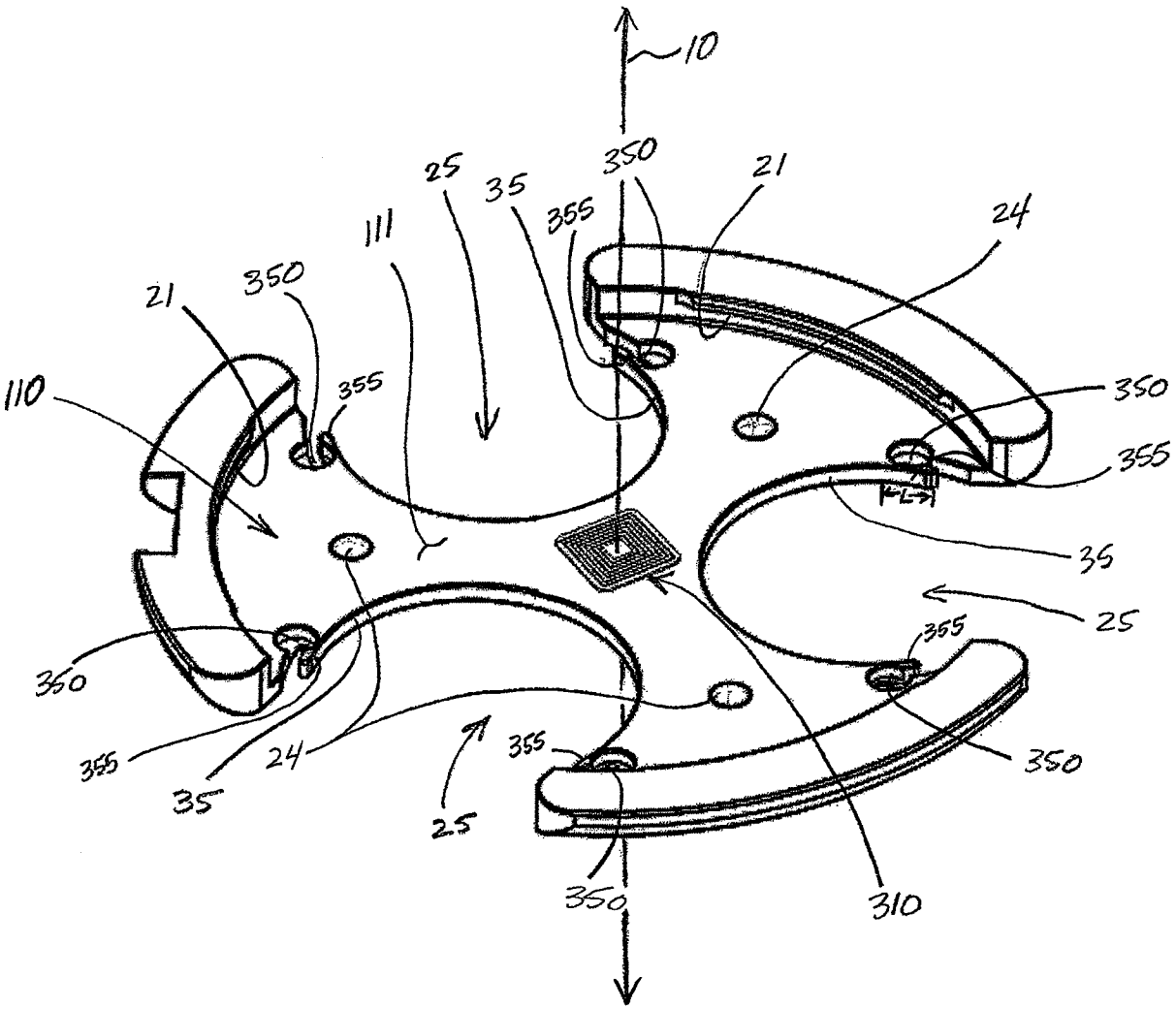
FIG. 3 is a perspective view of a plate of the assembly shown in FIGS. 1-2, according to some embodiments of the present invention.

FIG. 2 further illustrates a surface 26 of punch guide 160 including flanges 216 and recesses 246 providing for a quick-release-type engagement with mating features of plate 110. FIG. 3 is a perspective view of plate 110 illustrating a plurality of resilient members 24 protruding from a first face 111 thereof, for engagement within recesses 246, and illustrating a plurality of grooves 21 located about a perimeter of first face 111, for engagement with flanges 216. With reference to FIG. 3, the grooves 21 extend horizontally relative to, and are located above, the first face 111 of the plate 110. According to the illustrated embodiment, plate 110 is reversibly mounted to punch guide 160 by, first, bringing first face 111 into close proximity with surface 26 of guide 160, and, then, by rotating plate 110, about a centerline axis 10 (FIGS. 1-2), to engage grooves 21 with flanges 216 and to simultaneously bring protruding resilient members 24 into a quick-release-type engagement with recesses 246. With reference to FIGS. 2-3, it may be appreciated that engagement of grooves 21 with flanges 216 provides a holding force in a direction approximately parallel to centerline axis 10, while resilient members 24, engaged within recesses 246, provide a holding force in a direction approximately orthogonal to axis 10, for example, preventing rotation of plate 110 about axis 10.

Preferably, each of stripper members 101, 102, 103 is inserted into a corresponding gripper 25 of plate 110 after plate 110 is mounted to guide 160, but the invention is not so limited, and members 101, 102, 103 may be inserted prior to mounting, according to alternate embodiments. FIGS. 2-3 further illustrate each gripper 25 formed by a slot extending through plate 110 from first face 111 to a second face 112.

FIG. 3 shows each slot formed by a sidewall 35 that is terminated at opposite ends thereof by a pair of reliefs 350, wherein each relief 350 terminates a corresponding end of sidewall 35 and the ends are spaced apart by a gap. With reference to FIG. 3, each relief 350 is an aperture extending through the plate 110 from the first face to the second face thereof. Sidewalls 35 are resilient to provide an adequate gripping force about each member 101, 102, 103, and, according to some embodiments, are sized to extend within an optional groove 15 of each member 101, 102, 103; each relief 350 allows an adjacent or flexing portion 355 of sidewall 35 to flex and thus spread for insertion, as well as subsequent withdrawal, of the corresponding stripper member 101, 102, 103. With reference to FIG. 3, each flexing portion 355 is located between the adjacent aperture (of the relief 350) and the adjacent gripper 25. The gripping force of grippers 25 is sufficient to hold stripper members 101, 102, 103 in the proper position, as shown in FIG. 1, during punching operations in a punch press, without a need for additional retaining forces that can complicate the multi-tool punch assembly, such as from a ring component extending about a perimeter of plate 110, or from an extension of punch tools 51, 52, 53 through corresponding ports 151, 152, 153 of members 101, 102, 103. Grippers 25 may be described as providing a secure, yet reversible and quick-release-type engagement for stripper members 101, 102, 103 in order to facilitate simple and efficient exchange of any of stripper members 101, 102, 103 for an alternative stripper member, without having to disassemble other components of the multi-tool assembly.

Stripper members 101, 102, 103 may be inserted into the corresponding gripper 25 axially (in a direction approximately parallel to axis 10), or radially, per arrows A of FIG. 2, either before or after mounting plate 110 to punch guide 160. With reference to FIG. 1, when stripper members 101, 102, 103 are inserted into grippers 25, an exposed surface of each stripper member 101, 102, 103 may be recessed with respect to second face 112 of plate 110, flush with second face 112 of plate 110, or protruding from second face 112 of plate 110.

It should be noted that the present invention is not limited to any particular number of tools held in punch guide 160 and, according to alternate embodiments, plates for stripper assemblies are compatible with guides that can hold a fewer or a greater number of tools, than that which is illustrated in FIG. 2. For example, inventive plates for stripper assemblies may accommodate three tools, four tools, five tools, eight tools, ten tools, sixteen tools, twenty tools, twenty-four tools, and thirty tools, these numbers of tools being typical in the industry for multi-tool assemblies.

Figure 4:
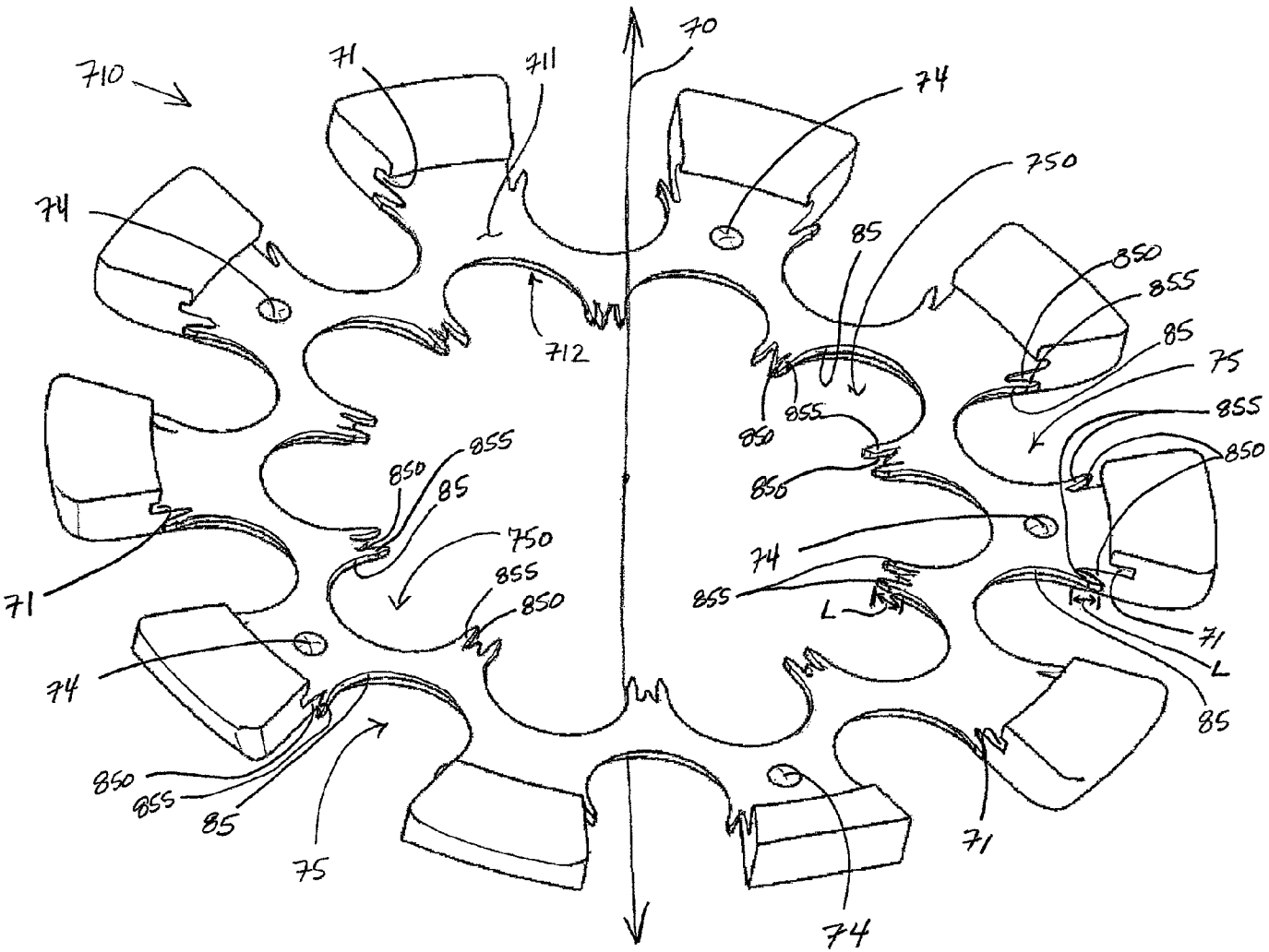
FIG. 4 is a perspective view of a plate for a stripper assembly, according to some alternate embodiments of the present invention.

FIG. 4 is a perspective view of another plate 710 which is configured to reversibly receive a greater number of stripper members than the number received by plate 110, in order to provide a stripper assembly for a multi-tool punch guide that has an increased capacity to carry a greater number of tools than punch guide 160. FIG. 4 illustrates plate 710 including a first plurality of grippers 75 and a second plurality of grippers 750; grippers 75 and 750 are each formed by a slot extending through plate 710 from a first face 711 to a second face 712, similar to grippers 25 of plate 110. Like grippers 25, the slots that form grippers 75 and 750 are each formed by a sidewall 85 that has opposite ends spaced apart by a gap, and wherein each end is terminated by a relief 850 that allows an adjacent or flexing portion 855 of sidewall 85 to flex and thus spread for insertion, as well as subsequent withdrawal, of a corresponding stripper member. According to the illustrated embodiment, the gap of each of the first plurality of grippers 75 faces away from a centerline axis 70 of plate 710, similar to each of grippers 25 of plate 110, but the gap of each of the second plurality of grippers 750 faces in an opposite direction, toward axis 70.

FIG. 4 further illustrates plate 710 including grooves 71, which are located about a perimeter of first face 711, and resilient members 74, which protrude from first face 711. According to the illustrated embodiment, resilient members 74 engage within recesses of a corresponding punch guide, similar to the previously described engagement of members 24, of plate 110, within recesses 246 of guide 160, when grooves 71 of plate 710 engage with flanges of the corresponding punch guide. Like plate 110, plate 710 is reversibly mounted to the corresponding punch guide by, first, bringing face 711 into close proximity with a surface of the guide that includes the mating flanges and recesses, and, then, by rotating plate 710, about centerline axis 70, to engage grooves 71 with the flanges and to simultaneously bring resilient members 74 into quick-release-type engagement with the recesses.

According to preferred embodiments of the present invention, stripper plates, for example, either of plates 110, 710, are formed from a relatively stiff, yet resilient polymer material, examples of which include, without limitation, Nylon 66, such as Zytel 103 HSL, Polyethylene terephthalate (PET), such as Rynite 530-BK503, and an acetal resin engineering plastic, such as Delrin 100KM NC000, which are all available from DuPont®. Stripper members that are received by either of plates 110, 710, for example, stripper members 101, 102, 103 (FIG. 2), may be formed from tool steels, such as 4140, M2 or D2, known to those skilled in the art, or from any of the aforementioned exemplary polymer materials. An embodiment of either of plates 110 and 710, which at least includes a polymer forming the respective second face 112, 712, is not as likely, as one formed entirely from metal, to mar a surface of a workpiece, if there is any contact between plate 110, 710 and the workpiece during punching operations. Furthermore, if a slug from the workpiece is inadvertently pulled up with one of the punch tools, for example, one of punch tools 51, 52, 53, it may become embedded in second face 112 of plate 110 that is formed by a polymer, and, thus, be less likely to significantly mar the workpiece; also, a polymer material, which forms either part of or all of plate 110, 710, may absorb shock and vibration that can cause unwanted noise and/or damage to components of the corresponding multi-tool punch assembly.

For those embodiments of plates 110, 710 formed from a resilient polymer, protruding resilient members 24, 74 and/or flexing portions 355, 855 of sidewalls 35, 85 may be integrally formed with plate 110, 710. Alternatively, plates 110, 710 may be formed from a material that is distinct from that which forms resilient members 24, 74 and flexing portions 355, 855, for example, a stiffer and less resilient material such as a hardened metal, like aircraft grade aluminum or titanium. Exemplary dimensions, for either of plates 110, 710, wherein the plate is wholly formed from Nylon 66, are as follows: an average thickness of plate 110, 710 ranges from approximately 1/16 inch to approximately 5/16 inch (thickness in direction approximately parallel to axis 10, 70); a length L of flexing portions 355, 855 ranges from approximately 1/8 inch to approximately 3/8 inch; and a maximum thickness of flexing portions 355, 855 is between approximately 1/4 inch and approximately 5/16 inch, while a minimum thickness thereof is between approximately 1/16 inch and approximately 1/8 inch (thicknesses in the flexing direction, approximately orthogonal to axis 10, 70).

Figure 5:
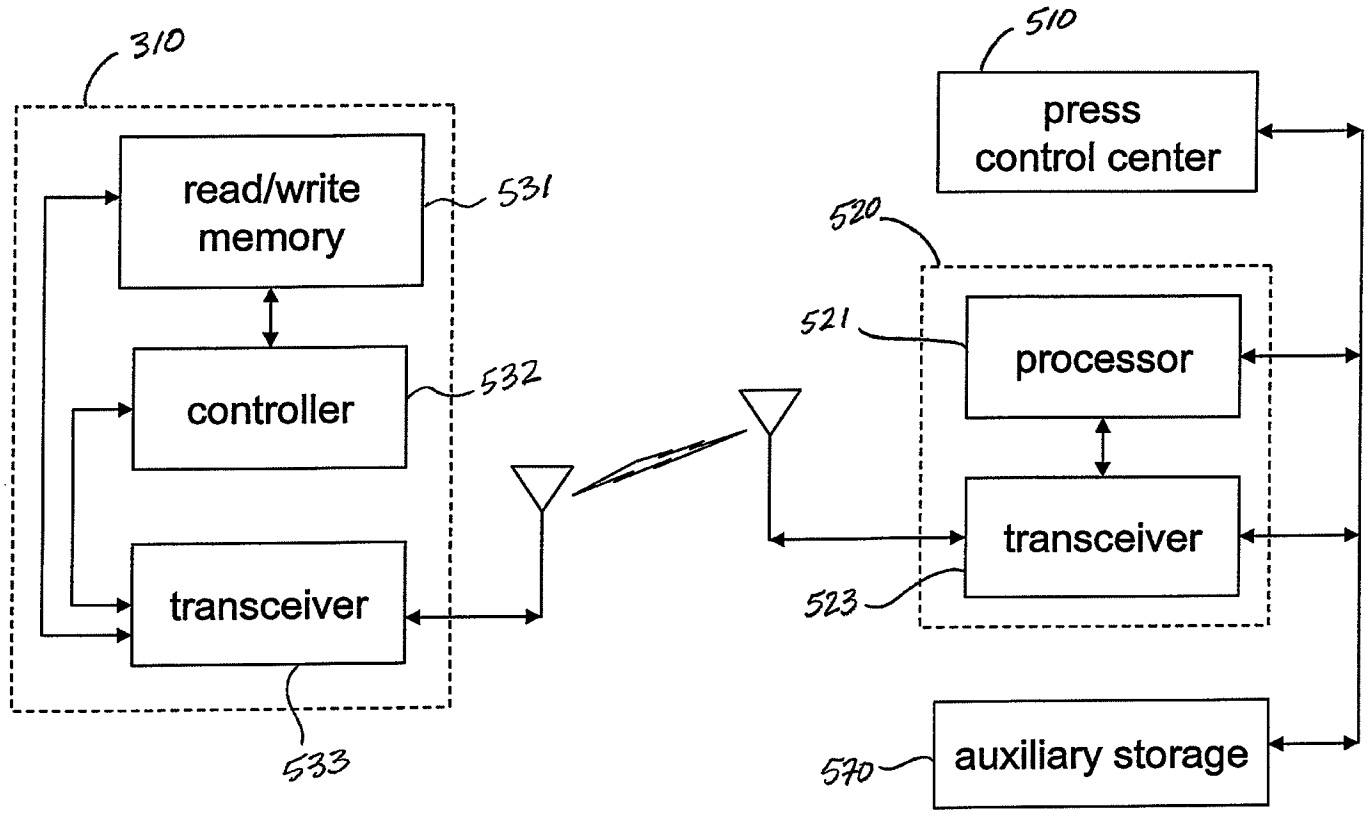
FIG. 5 is a block diagram for an exemplary information storage device and reader which may be employed by embodiments of the present invention.

According to another aspect of the present invention, stripper assembly 100 includes an information storage device to help to manage implementations of various punch tools, for example, tools 51, 52, 53 (FIG. 2). With reference to FIG. 3, such an information storage device 310 is shown coupled to first face 111 of plate 110. According to some embodiments of the present invention, information storage device 310 is adapted to store punch tool identification/characterization information, and/or punch tool prior usage information, and/or punch tool maintenance information. Storage device 310 may store tool information as a coded data pattern, for example, in the form of a bar code tag, but is preferably programmable, including a read/write memory, and has a capacity for wireless communications, for example, being a type of radio-frequency (RF) identification tag that includes an antenna and an integrated circuit for storing and processing information and for modulating and demodulating an RF signal. FIG. 5 is a block diagram for such an information storage device 310, and for an associated reader 520.

FIG. 5 illustrates storage device 310 including a read/write memory 531 linked to a transceiver 533 for sending information to, and receiving information from reader 520. FIG. 5 further illustrates storage device 310 including a controller 532, for example, a processor unit, in communications with both read/write memory 531 and transceiver 533 to perform reprogramming operations. According to the illustrated embodiment, reader 520, which includes a processor 521 and a transceiver 523, is linked to a press control center 510, and to an auxiliary storage 570 for data collected from information storage device 310 and for information sent to information storage device 310 from press control center 510. Examples of storage device 310 and reader 520, in conjunction with press control center 510 and auxiliary storage 570, which may be employed by embodiments of the present invention, are described in detail in U.S. Pat. No. 6,047,579, which is hereby incorporated by reference in its entirety.

Returning now to FIGS. 1-3, it may be appreciated that information storage device 310, being mounted to first face 111 of plate 110, is contained between plate 110 and surface 26 of punch guide 160, when plate 110 is mounted to guide 160, and that wireless data transmission therefrom is not hindered by the containment. Thus, during punching operations, when the complete multi-tool punch assembly is mounted in a punch press, storage device 310 is enclosed, within the assembly, for protection from the environment of the press. In addition to protecting information storage device 310 from exposure to processing materials of the press, such as lubricants and coolants, if at least portions of plate 110 are formed from a resilient polymer, as mentioned above, plate 110 can further protect storage device 310 by absorbing shock and vibration that may result when any of the punch tools form the workpiece, and when stripper members 101, 102, 103 and/or plate 110 contact the workpiece during punching operations.

With further reference to FIG. 1, a passive information storage device, being embodied as a bar code tag 13, is shown attached to second face 112 of plate 100; tag 13 may contain encoded data corresponding to permanent identification information associated with plate 110. According to the illustrated embodiment, tag 13 is exposed, when plate 110 is mounted to guide 160, in order that a bar code reader may obtain the information therefrom, and is not as susceptible to punch press environmental damage as information storage device 310 would be if similarly exposed.

Figure 6:
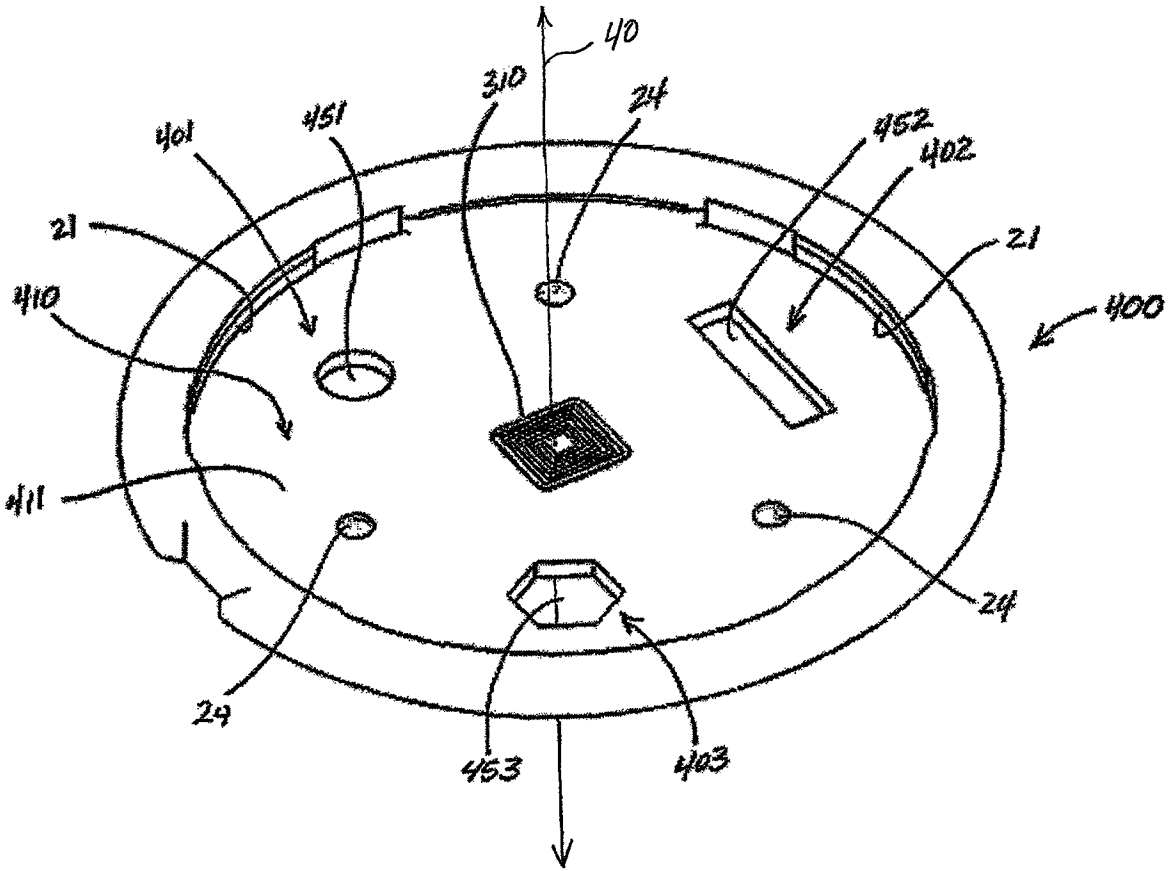
FIG. 6 is a perspective view of an alternative embodiment of a stripper assembly.

FIG. 6 is a perspective view of an alternative embodiment of a stripper assembly 400. FIG. 6 illustrates assembly 400 including a plate 410 having a plurality of strippers 401, 402, 403 integrally formed therein, and wherein each stripper 401, 402, 403 includes a punch port 451, 452, 453. According to some preferred embodiments of stripper assembly 400, punch ports 451, 452, 453 are formed, after plate 410 is initially mounted to a punch guide, for example, punch guide 160 (FIGS. 1-2), by tools 51, 52, 53, which are mounted in guide 160 and driven by a press in which the entire multi-tool punch assembly is mounted.

Like plate 110, previously described, plate 410 may be mounted to punch guide 160 by bringing a first face 411 thereof into close proximity with surface 26 of guide 160 and rotating plate 410, about a centerline axis 40 to engage grooves 21 with flanges 216 and to simultaneously engage protruding resilient members 24 with recesses 246. Also, like plate 110, plate 410 may be formed, all, or in part, from a resilient polymer material. FIG. 6 further illustrates stripper assembly 400 including information storage device 310, as previously described, which is coupled to first face 411 of plate 410, so that when plate 410 is mounted to guide 160, storage device 310 is contained between plate 410 and punch guide surface 26.

Figure 7:
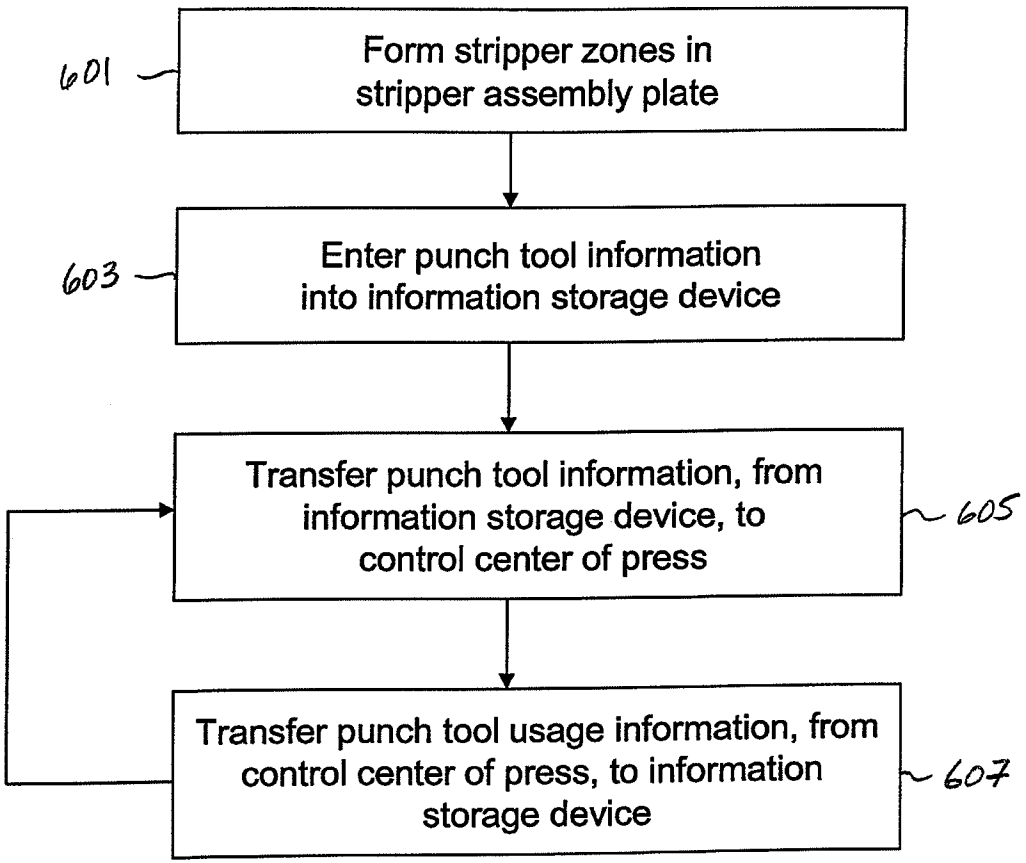
FIG. 7 is a flow chart outlining some methods of the present invention.

FIG. 7 is a flow chart outlining some methods of the present invention related to the information storage aspect thereof. FIG. 7 illustrates an initial step 601 wherein strippers are formed in a plate of a stripper assembly; formation of strippers may be performed by inserting individual stripper members into a the plate, for example, members 101, 102, 103 into grippers 25 of plate 110, as previously described in conjunction with FIGS. 1-3, or by punching ports into the plate, for example, ports 451, 452, 453, as previously described in conjunction with FIG. 7. In a subsequent step 603, punch tool information is entered into an information storage device, for example, storage device 310, which is coupled to the plate of the stripper assembly; the information may be dictated by the formed strippers and includes information identifying a geometry and unique position of each tool, for example, tools 51, 52, 53 (FIG. 2), within a punch guide to mate up with the corresponding punch port 151, 152, 153. The punch tool information may further include a length of each selected punch tool, material properties thereof, a usage history thereof, and/or a maintenance history thereof; this additional information may be collected from an information storage device, which is coupled to each punch tool and is similar to device 310, as previously described.

The stripper assembly may be mounted to the punch guide, as previously described in conjunction with FIGS. 1-3, either before or after each of the punch tools is mounted into the corresponding unique position in the punch guide; and the strippers may be formed in the stripper assembly plate either before or after the stripper assembly plate is mounted to the punch guide. According to some alternate embodiments of the present invention, step 603 precedes step 601.

FIG. 7 further illustrates a step 605, following step 603, in which the storage device transfers the information to a control center of the press, for example, via wireless RF transmission to reader 520, which is linked to press control center 510, as previously described in conjunction with FIG. 5. The control center of the press uses the transferred information to control punching operations, which are carried out by the punch tools mounted in the guide of the multi-tool punch assembly, which has been mounted in the press. The multi-tool punch assembly may be mounted in the press at any time following step 601, unless the stripper assembly plate, which is mounted to the guide, initially includes no strippers and the strippers are to be formed by punching, as previously described in conjunction with FIG. 6.

After a workpiece has been processed in the punch press, the control center of the press transfers, back to the information storage device of the corresponding stripper assembly plate, per step 607, data concerning the operation of each punch tool, for example, punching frequency, forces applied, die penetration, jobs processed, index angle, etc. . . . Thus, the punch tool information, which is contained in the information storage device, is updated to reflect the usage history of each punch tool mounted in the corresponding multi-tool punch assembly; the updated information may be subsequently transferred back to the control center of the same press, or another press, when the multi-tool assembly is employed again to process another workpiece.

In the foregoing detailed description, the invention has been described with reference to specific embodiments. However, it may be appreciated that various modifications and changes can be made without departing from the scope of the invention as set forth in the appended claims.

The invention claimed is:

1. A stripper assembly plate comprising:

a first face, a second face and a centerline axis;

a plurality of grooves located around a perimeter of the first face and facing toward the centerline axis of the plate, each groove adapted to engage with a corresponding flange of a punch guide when aligned therewith; and a plurality of gripper slots extending through the plate from the first face to the second face thereof, each gripper slot of the plurality of gripper slots being formed by a sidewall, the sidewall including a first end and a second end, the second end being spaced apart from the first end by a gap, the first end being terminated by one relief and the second end being terminated by another relief, each sidewall having a first flexing portion adjacent said first end and a second flexing portion adjacent said second end;

wherein the reliefs of each gripper slot allow for insertion and withdrawal of a corresponding stripper member, such that each gripper slot is configured to releasably couple the corresponding stripper member to the plate, the flexing portions of each sidewall being configured to flex and thereby spread in response to the insertion or withdrawal of the corresponding stripper member with the gripper slot.

2. The plate of claim 1, wherein the gap of at least some of the gripper slots faces away from the centerline axis of the plate.

3. The plate of claim 1, wherein the gap of at least some of the gripper slots faces toward the centerline axis of the plate.

4. The plate of claim 1, wherein the plate is formed from a resilient polymer material.

5. The plate of claim 1, further comprising an information storage device coupled to the first face of the plate.

6. The plate of claim 5, wherein the information storage device is adapted to store at least one of: punch tool identification information, punch tool prior usage information, and punch tool maintenance information.

7. The plate of claim 5, wherein the information storage device comprises a read/write memory and a communications transceiver.

8. The plate of claim 5, wherein the information storage device is selected from the group consisting of: a radiofrequency identification tag and a bar code tag.

9. The plate of claim 1 wherein the flexing portions of each sidewall are integral to the sidewall.

10. The plate of claim 1 wherein each relief is an aperture extending through the plate from the first face to the second face thereof.

11. The plate of claim 10 wherein each flexing portion is located between the adjacent aperture and the adjacent gripper slot.

12. The plate of claim 1 wherein the flexing portions of each sidewall are configured to flex from contact with the corresponding stripper member during the insertion and withdrawal and to recoil following said insertion and withdrawal.

13. The plate of claim 1, wherein the plate is adapted for use with a multi-tool punch guide.

14. The stripper assembly plate of claim 13, wherein the grooves extend horizontally relative to, and are located above, the first face of the plate and are adapted to be engaged by rotating the plate, about the centerline axis thereof, with respect to a surface of the punch guide, after bringing the first face of the plate into close proximity with the punch guide surface, the punch guide surface being that through which each punch tool, of a plurality of punch tools carried by the punch guide, extends when activated.

15. The plate of claim 14, wherein each groove of the plurality of grooves is integrally formed in the plate.

16. The plate of claim 14, further comprising a plurality of resilient members protruding from the first face, each resilient member of the plurality of resilient members being adapted to reversibly engage within a corresponding recess located on the surface of the punch guide, when each groove is adapted to engage with the corresponding flange of the punch guide.

17. The plate of claim 16, wherein each resilient member of the plurality of resilient members is located between adjacent gripper slots of the plurality of gripper slots.

18. The plate of claim 16, wherein the plate is formed from a resilient polymer material.

19. The plate of claim 18, wherein each resilient member of the plurality of resilient members is integrally formed in the plate.

20. A stripper assembly comprising:

a stripper assembly plate comprising:

a first face, a second face and a centerline axis extending through the first and second faces, wherein the plate is configured to engage with strippers;

a plurality of grooves located around a perimeter of the first face of the plate and facing toward the centerline axis of the plate, each groove adapted to engage with a corresponding flange of a punch guide when aligned therewith; and a plurality of resilient members protruding from the first face of the plate, each resilient member adapted to engage within a corresponding recess located on a surface of the punch guide when each groove engages with the corresponding flange of the punch guide, the surface of the punch guide being that through which each punch tool, of a plurality of punch tools carried by the punch guide, extends, when activated;

wherein the plurality of grooves and the plurality of resilient members are adapted to be engaged by rotating the plate, about the centerline axis thereof, with respect to the surface of the punch guide, after bringing the first face of the plate into close proximity with the surface of the punch guide, such that the engaged grooves provide a holding force in a direction approximately aligned with the centerline axis of the plate; and the engaged resilient members provide a holding force in a direction approximately orthogonal to the centerline axis of the plate; and a plurality of strippers, wherein each of the strippers is releasably coupled to and approximately coplanar with the plate.

21. The stripper assembly of claim 20, wherein each groove of the plurality of grooves is located between adjacent strippers of the plurality of strippers.

22. The stripper assembly of claim 20, wherein each resilient member of the plurality of resilient members is located between adjacent strippers of the plurality of strippers.

23. The stripper assembly of claim 20, wherein each groove of the plurality of grooves is integrally formed in the plate.

24. The stripper assembly of claim 20, wherein the plate is formed from a resilient polymer material.

25. The stripper assembly of claim 24, wherein each resilient member of the plurality of resilient members is integrally formed in the plate.

26. The stripper assembly of claim 20, wherein each stripper of the plurality of strippers is formed by an individual stripper member releasably coupled to the plate.

27. The stripper assembly of claim 26, wherein:

the plate further includes a plurality of grippers; and each gripper of the plurality of grippers is configured to extend about at least a portion of a perimeter of a corresponding individual stripper member of the plurality of strippers to releasably couple each stripper member to the plate.

28. The stripper assembly of claim 27, wherein:

each individual stripper member includes a groove extending about the perimeter thereof; and each of the plurality of grippers extends into the groove of the corresponding individual stripper member when releasably coupling each stripper member to the plate.

29. The stripper assembly of claim 27, wherein:

each gripper of the plurality of grippers is formed by a slot extending through the plate from the first face of the plate to the second face of the plate;

each slot is formed by a sidewall, the sidewall including a first end and a second end, the second end being spaced apart from the first end by a gap, and each of the first and second ends being terminated by a relief; and the reliefs allowing for an insertion and a withdrawal of each individual stripper member into a corresponding gripper.

30. The stripper assembly of claim 29, wherein the gap of at least some of the grippers faces away from the centerline axis of the plate.

31. The stripper assembly of claim 29, wherein the gap of at least some of the grippers faces toward the centerline axis of the plate.

32. The stripper assembly of claim 29, wherein each resilient member of the plurality of resilient members is located between adjacent grippers of the plurality of grippers.

33. The stripper assembly of claim 26, wherein each groove of the plurality of grooves is integrally formed in the plate.

34. The stripper assembly of claim 26, wherein the plate is formed from a resilient polymer material.

35. The stripper assembly of claim 34, wherein each resilient member of the plurality of resilient members is integrally formed in the plate.

36. The stripper assembly of claim 20, further comprising an information storage device coupled to the first face of the plate.

37. The stripper assembly of claim 36, wherein the information storage device is adapted to store at least one of: punch tool identification information, punch tool prior usage information, and punch tool maintenance information.

38. The stripper assembly of claim 36, wherein the information storage device comprises a read/write memory and a communications transceiver.

39. The stripper assembly of claim 36, wherein the information storage device is selected from the group consisting of: a radiofrequency identification tag and a bar code tag.

40. The stripper assembly of claim 20, wherein each stripper includes a punch port extending therethrough, from the first face of the plate to the second face of the plate, wherein each punch port is configured to be aligned with a corresponding punch tool of the plurality of punch tools carried by the punch guide, when the plurality of grooves and the plurality of resilient members are each engaged.

41. A stripper assembly comprising:

a stripper assembly plate comprising:

a first face, a second face and a centerline axis;

a plurality of grooves located around a perimeter of the first face and facing toward the centerline axis of the plate, each groove adapted to engage with a corresponding flange of a punch guide when aligned therewith; and a plurality of gripper slots extending through the plate from the first face to the second face thereof, each gripper slot of the plurality of gripper slots being formed by a sidewall, the sidewall including a first end and a second end, the second end being spaced apart from the first end by a gap, the first end being terminated by one relief and the second end being terminated by another relief, each sidewall having a first flexing portion adjacent said first end and a second flexing portion adjacent said second end;

wherein the reliefs of each gripper slot allow for insertion and withdrawal of a corresponding stripper member, such that each gripper slot is configured to releasably couple the corresponding stripper member to the plate, the flexing portions of each sidewall being configured to flex and thereby spread in response to the insertion or withdrawal of the corresponding stripper member with the gripper slot; and a plurality of stripper members, wherein each of the stripper members is releasably coupled to and approximately coplanar with the plate such that a punch port of each coupled stripper member extends from the first face of the plate to the second face of the plate.

* * * * *